US009099291B2

(12) United States Patent
Atol et al.

(10) Patent No.: US 9,099,291 B2
(45) Date of Patent: Aug. 4, 2015

(54) IMPEDANCE TUNING OF AN ELECTRODE-LESS PLASMA LAMP

(71) Applicant: Topanga USA, Inc., Canoga Park, CA (US)

(72) Inventors: Dane I. Atol, Canoga Park, CA (US); Timothy J. Brockett, Oakland, CA (US)

(73) Assignee: Topanga USA, Inc., Canoga Park, CA (US)

( * ) Notice: Subject to any disclaimer, the term of this patent is extended or adjusted under 35 U.S.C. 154(b) by 0 days.

(21) Appl. No.: 14/259,118

(22) Filed: Apr. 22, 2014

(65) Prior Publication Data

US 2014/0354148 A1 Dec. 4, 2014

Related U.S. Application Data

(60) Provisional application No. 61/830,529, filed on Jun. 3, 2013.

(51) Int. Cl.
*H01J 19/80* (2006.01)
*H01J 65/04* (2006.01)

(52) U.S. Cl.
CPC ..... *H01J 65/048* (2013.01)

(58) Field of Classification Search
USPC ..... 315/39, 248, 111.21, 111.71; 313/252, 313/231.31, 231.41, 567, 594, 633
See application file for complete search history.

(56) References Cited

U.S. PATENT DOCUMENTS

| | | | |
|---|---|---|---|
| 3,593,056 | A | 7/1971 | Degawa et al. |
| 3,679,928 | A | 7/1972 | Johnson |
| 3,943,403 | A | 3/1976 | Haugsjaa et al. |
| 3,943,404 | A | 3/1976 | McNeill et al. |
| 4,001,631 | A | 1/1977 | McNeill et al. |
| 4,001,632 | A | 1/1977 | Haugsjaa et al. |
| 4,002,944 | A | 1/1977 | McNeill et al. |
| 4,065,701 | A | 12/1977 | Haugsjaa et al. |
| 4,185,228 | A | 1/1980 | Regan |

(Continued)

FOREIGN PATENT DOCUMENTS

| | | |
|---|---|---|
| JP | 2004-139852 A | 5/2004 |

OTHER PUBLICATIONS

Bogaerts, et al., "Gas Discharge Plasmas and their Applications," Spectrochimica Acta, Part B 57, 2002, pp. 609-658.

(Continued)

*Primary Examiner* — Jimmy Vu

(74) *Attorney, Agent, or Firm* — Kilpatrick Townsend and Stockton LLP

(57) ABSTRACT

A method for operating a plasma lamp apparatus. The method includes providing a resonator structure configured with a bulb comprising a fill mixture. The bulb is coupled to an output coupling element. The method applying an RF power source to a resonator structure configured with an input coupling element and coupling the RF power to the output coupling element configured with the input coupling element to cause the fill mixture to discharge electromagnetic radiation. The method includes adjusting a spatial distance or relative configuration between the input coupling element and the output coupling element during output of the electromagnetic radiation and causing a change in an impedance value of the resonator structure to initiate an adjustment of a power transfer from the RF power source to an output of the electromagnetic radiation.

20 Claims, 9 Drawing Sheets

(56) References Cited

U.S. PATENT DOCUMENTS

| | | | |
|---|---|---|---|
| 4,498,029 | A | 2/1985 | Yoshizawa et al. |
| 4,597,035 | A | 6/1986 | Lettenmeyer |
| 4,774,637 | A | 9/1988 | Budde et al. |
| 4,975,655 | A | 12/1990 | Dawson et al. |
| 5,615,947 | A | 4/1997 | Shambo et al. |
| 5,637,963 | A | 6/1997 | Inoue et al. |
| 5,686,793 | A | 11/1997 | Turner et al. |
| 5,708,331 | A | 1/1998 | Vamvakas et al. |
| 5,757,130 | A | 5/1998 | Dolan et al. |
| 5,777,857 | A | 7/1998 | Degelmann |
| 5,834,895 | A | 11/1998 | Dolan et al. |
| 5,838,108 | A | 11/1998 | Frank et al. |
| 5,841,233 | A | 11/1998 | Ury et al. |
| 5,852,339 | A | 12/1998 | Hamilton et al. |
| 5,886,480 | A | 3/1999 | Penzenstadler et al. |
| 5,923,122 | A | 7/1999 | Frank et al. |
| 6,137,237 | A | 10/2000 | MacLennan et al. |
| 6,241,369 | B1 | 6/2001 | Mackiewicz |
| 6,323,601 | B1 | 11/2001 | Klein et al. |
| 6,348,669 | B1 | 2/2002 | Rudd Little et al. |
| 6,372,186 | B1 | 4/2002 | Fencl et al. |
| 6,476,557 | B1 | 11/2002 | Leng et al. |
| 6,617,806 | B2 | 9/2003 | Kirkpatrick et al. |
| 6,737,809 | B2 | 5/2004 | Espiau et al. |
| 6,856,092 | B2 | 2/2005 | Pothoven et al. |
| 6,922,021 | B2 | 7/2005 | Espiau et al. |
| 7,119,641 | B2 | 10/2006 | Petrov et al. |
| 7,291,785 | B2 | 11/2007 | Riester et al. |
| 7,291,985 | B2 | 11/2007 | Espiau et al. |
| 7,348,732 | B2 | 3/2008 | Espiau et al. |
| 7,350,936 | B2 | 4/2008 | Ducharme et al. |
| 7,358,678 | B2 | 4/2008 | Espiau et al. |
| 7,362,054 | B2 | 4/2008 | Espiau et al. |
| 7,362,055 | B2 | 4/2008 | Espiau et al. |
| 7,362,056 | B2 | 4/2008 | Espiau et al. |
| 7,372,209 | B2 | 5/2008 | Espiau et al. |
| 7,391,158 | B2 | 6/2008 | Espiau et al. |
| 7,719,195 | B2 | 5/2010 | DeVincentis et al. |
| 7,830,092 | B2 | 11/2010 | Espiau et al. |
| 8,282,435 | B2 | 10/2012 | Espiau |
| 8,283,866 | B2 | 10/2012 | Espiau et al. |
| 8,294,368 | B2 | 10/2012 | Espiau et al. |
| 8,294,382 | B2 | 10/2012 | DeVincentis et al. |
| 8,545,067 | B2 | 10/2013 | Espiau |
| 8,629,616 | B2 | 1/2014 | Doughty |
| 2004/0056600 | A1 | 3/2004 | Lapatovich et al. |
| 2005/0094940 | A1 | 5/2005 | Gao |
| 2005/0095946 | A1 | 5/2005 | Fridrich |
| 2005/0212456 | A1 | 9/2005 | Espiau et al. |
| 2006/0250090 | A9 | 11/2006 | Guthrie |
| 2007/0109069 | A1 | 5/2007 | Espiau et al. |
| 2007/0222352 | A1 | 9/2007 | DeVincentis et al. |
| 2008/0054813 | A1 | 3/2008 | Espiau et al. |
| 2008/0227320 | A1 | 9/2008 | Witham et al. |
| 2008/0258627 | A1* | 10/2008 | DeVincentis et al. ..... 315/39 |
| 2010/0134008 | A1 | 6/2010 | Espiau et al. |
| 2012/0014118 | A1 | 1/2012 | Espiau et al. |

OTHER PUBLICATIONS

International Search Report and Written Opinion of PCT Application No. PCT/US09/048174, mailed on Aug. 17, 2009, 17 pages total.

* cited by examiner

IMPEDANCE TUNING OF AN ELECTRODE-LESS PLASMA LAMP

CROSS-REFERENCES TO RELATED APPLICATIONS

This application claims priority to U.S. Provisional Patent Application No. 61/830,529, filed Jun. 3, 2013, entitled "IMPEDANCE TUNING OF AN ELECTRODE-LESS PLASMA LAMP," by inventors Dane I. Atol and Timothy J. Brockett, commonly assigned and incorporated by reference herein for all purposes. This application is also related to U.S. Pat. No. 7,830,092, issued Nov. 9, 2010, and titled "Electrodeless lamps with externally-grounded probes and improved bulb assemblies," commonly assigned, and hereby incorporated by reference in its entirety.

BACKGROUND OF THE INVENTION

The present invention is directed to devices and methods for generating light with plasma lamps. More particularly, the present invention provides plasma lamps driven by a radio-frequency source without the use of electrodes inside a gas-filled vessel (bulb) and related methods. Merely by way of example, such plasma lamps can be applied to applications such as stadiums, security, parking lots, military and defense, streets, large and small buildings, vehicle headlamps, aircraft landing, bridges, warehouses, uv water treatment, agriculture, architectural lighting, stage lighting, medical illumination, microscopes, projectors and displays, any combination of these, and the like.

Plasma lamps provide extremely bright, broadband light, and are useful in applications such as general illumination, projection systems, and industrial processing. The typical plasma lamp manufactured today contains a mixture of gas and trace substances that is excited to form a plasma using a high current passed through closely-spaced electrodes. This arrangement, however, suffers from deterioration of the electrodes, and therefore a limited lifetime.

Electrodeless plasma lamps driven by microwave sources have been proposed in the prior art. Conventional configurations include a plasma fill encased either in a bulb or a sealed recess within a dielectric body forming a waveguide, with microwave energy being provided by a source such as a magnetron and introduced into the waveguide and heating the plasma resistively. Another example is provided by U.S. Pat. No. 6,737,809 B2 (Espiau et. al.), which shows a different arrangement that has limitations. Espiau et al. shows a plasma-enclosing bulb and a dielectric cavity forming a part of a resonant microwave circuit with a microwave amplifier to provide excitation. Several drawbacks, however, exist with Espiau et al. The dielectric cavity is a spatially positioned around a periphery of the plasma-enclosing bulb in an integrated configuration, which physically blocks a substantial portion of the electromagnetic radiation in the form of light emitted from the bulb particularly in the visible region. Additionally, the integrated configuration is generally difficult to manufacture and limits the operation and reliability of the plasma-enclosing bulb. These and other limitations of conventional techniques may be further described throughout the present specification and more particularly below.

From above, it is seen that techniques for improved lighting are highly desired.

BRIEF SUMMARY OF THE INVENTION

According to the present invention, techniques directed to devices and methods for generating light with plasma lamps are provided. More particularly, the present invention provides plasma lamps driven by a radio-frequency source without the use of electrodes inside a gas-filled vessel (bulb) and related methods. Merely by way of example, such plasma lamps can be applied to applications such as stadiums, security, parking lots, military and defense, streets, large and small buildings, vehicle headlamps, aircraft landing, bridges, warehouses, uv water treatment, agriculture, architectural lighting, stage lighting, medical illumination, microscopes, projectors and displays, any combination of these, and the like.

In a specific embodiment, the present invention provides a method of tuning the impedance of an operating plasma lamp. The method, providing a plasma lamp comprising of a resonator structure configured with a bulb and RF power source, wherein applying RF power to the resonator structure causes the bulb to discharge electromagnetic radiation. The resonator structure, comprised of an input coupling element and output coupling element and configured between the RF source and bulb, provides a tuning platform that can be adjusted to change the impedance value of the resonator structure to initiate a change in overall power transfer from the RF power source to the bulb or the increase the efficiency of the RF power source. The tuning can be achieved by changing the spatial distance or relative configuration between the input and output coupling element and/or introducing a specific tuning element that can be configured in the vicinity of the coupling elements.

In an example, the present invention provides a method for operating a plasma lamp apparatus. The method includes providing a resonator structure configured with a bulb comprising a fill mixture. The bulb is coupled to an output coupling element. The method applying an RF power source to a resonator structure configured with an input coupling element and coupling the RF power to the output coupling element configured with the input coupling element to cause the fill mixture to discharge electromagnetic radiation. The method includes adjusting a spatial distance or relative configuration between the input coupling element and the output coupling element during output of the electromagnetic radiation and causing a change in an impedance value of the resonator structure to initiate an adjustment of a power transfer from the RF power source to an output of the electromagnetic radiation.

Benefits are achieved over pre-existing techniques using the present invention. In a specific embodiment, the present invention provides a method and device having configurations of input, output, and feedback coupling-elements that provide for electromagnetic coupling to the bulb whose power transfer and frequency resonance characteristics that are largely independent of the conventional dielectric resonator. In a preferred embodiment, the present invention provides a method and configurations with an arrangement that provides for improved manufacturability as well as design flexibility. Other embodiments may include integrated assemblies of the output coupling element and bulb that function in a complementary manner with the present coupling element configurations and related methods. Still further, the present method and device provide for improved heat transfer characteristics, as well as further simplifying manufacturing. In a specific embodiment, the present method and resulting structure are relatively simple and cost effective to manufacture for commercial applications. Depending upon the embodiment, one or more of these benefits may be achieved. These and other benefits may be described throughout the present specification and more particularly below.

The present invention achieves these benefits and others in the context of known process technology. However, a further understanding of the nature and advantages of the present invention may be realized by reference to the latter portions of the specification and attached drawings.

DETAILED DESCRIPTION OF THE INVENTION

Figure 1:
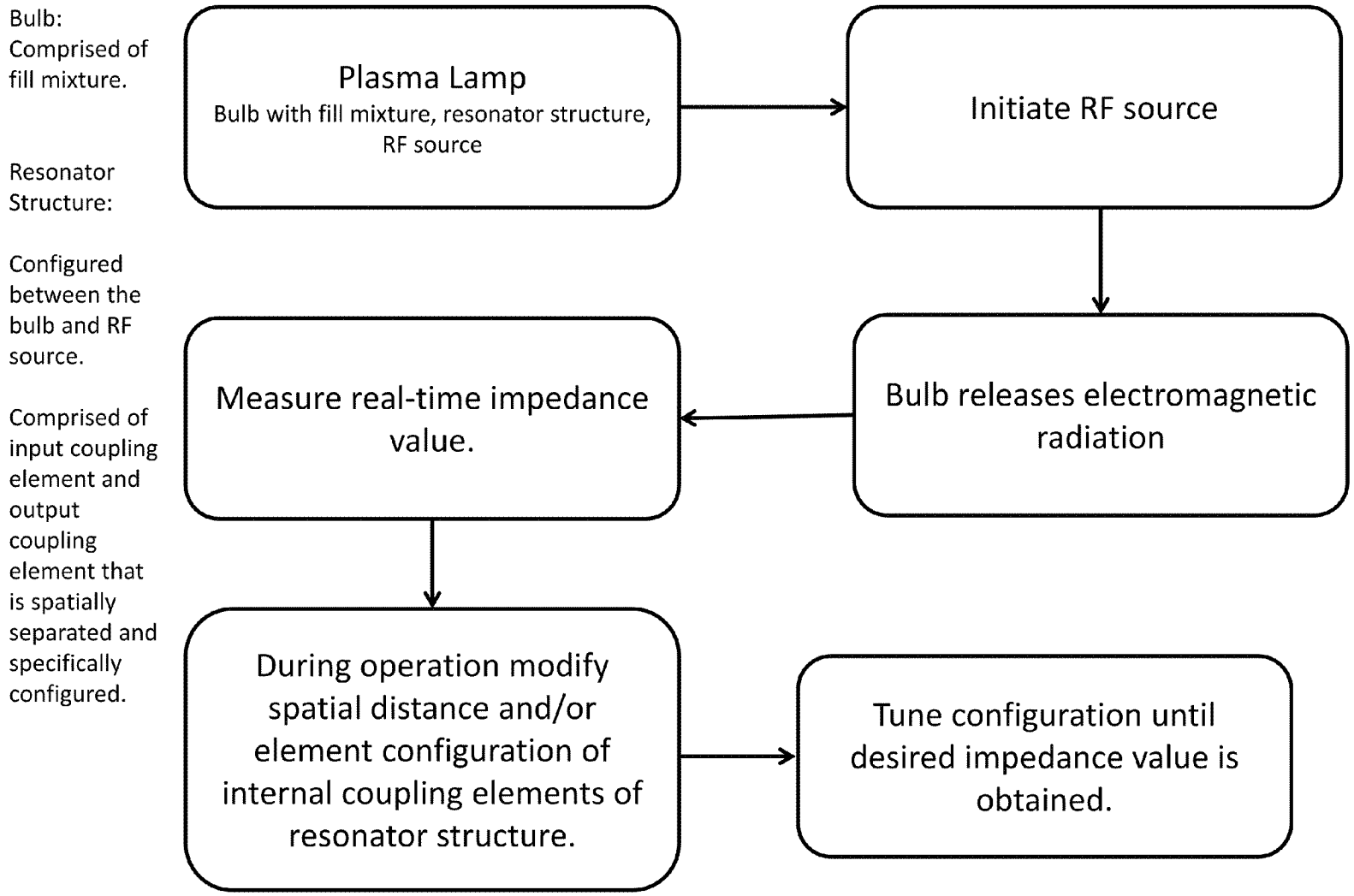
FIG. 1 is a simplified flow diagram of a tuning method for a plasma lamp according to an embodiment of the present invention.

According to the present invention, a method of tuning the impedance of a plasma lamp is provided. The method is applied to an operating plasma lamp apparatus that is comprised of a bulb, resonator structure, and RF power source. The bulb is comprised of a fill mixture that when exposed to concentrated RF power, discharges electromagnetic radiation in the form of infrared, visible, or ultraviolet light. The resonator structure mechanically supports the bulb, provides heat regulation, concentrates RF energy in the vicinity of the bulb, and acts as an RF matching network between the bulb and the RF power source. The resonator structure is generally comprised of a main body that can be made of metal, metallized material, or a dielectric that is configured with an input coupling element that accepts the RF signal from the RF power source and an output coupling element that is configured with the bulb. The input coupling element and the output coupling element are designed to be spatially separated and are configured to allow RF energy to transfer efficiently from the RF power source to the bulb.

The configuration between the input and output coupling elements and the structure of the main body can be characterized by an impedance value measured in Ohms. Similarly, the RF power source and the bulb can be characterized by an impedance value. Setting the impedance value of the resonator structure is essential in providing power transfer from the RF power source to the bulb. In most embodiments, it is desirable to transfer near-to-all or all power from the RF power source to the bulb to maximize lamp efficiency. In fundamental circuit physics, maximized power transfer occurs when the impedance values of all components are the same or "matched". To achieve this condition, the resonator structure, which in part acts as an impedance transformer or "matching network", must be impedance tuned to provide a match between the RF source impedance and bulb impedance.

In the current embodiment, the resonator structure impedance tuning is achieved through adjusting the configuration between the input coupling element and the output coupling element. This is accomplished during the assembly stage, where the input and output coupling elements are configured and then fixed. After assembly, the impedance value is measured. If the measured impedance value is not at the desired value, the resonator structure must be taken out of the production process for partial disassembly where its input and output coupling elements can be reconfigured. Once reconfigured, the resonator structure is brought back into the production process again and re-measured. This can be repeated until the desired impedance value is obtained. Depending on the assembly tolerances, this process can be repeated several times, reducing throughput, increasing production costs, and increasing manufacturing complication.

From this standpoint, it is highly desirable to design the resonator structure with an impedance tuning device that can be used during the measurement stage. With an impedance tuning device, the impedance can be adjusted on-the-fly and then fixed, eliminating the need to partially dissemble and reconfigure the coupling elements. This will significantly improve throughput and production efficiency. Impedance tuning in the current embodiment is achieved by changing the relative configuration between the input coupling element and output coupling element. This change can be, but not limited to: Changing the spatial distance between the input and output coupling element; changing the effective diameter or electrical properties of either the input coupling element, the output coupling element, or both; changing the relative physical configuration (i.e. rotating, tilting, translating) between the input coupling element and the output coupling element.

An on-the-fly impedance tuning device can encompass any mechanical or electronic method that changes the configuration or spatial distance between the input and output coupling element. Devices can include, but not be limited to, rotating dials or set-screws; linear translating devices; metal, metallized, or dielectric sleeves that are attached to one or both coupling elements. Each of these devices are designed to change the configuration or spatial distance between the input and output coupling elements in the following ways: spatially displacing linearly, rotationally, or in a spiral pattern; tilting or bending one or both coupling elements in relation to one another; modifying the effective diameter, shape, and/or electric properties of one or both coupling elements by introducing a metal, metallized, or dielectric sleeve.

Each device works during lamp operation, where the devices can be adjusted to the desired impedance value and then locked down. The devices introduced here are provided as examples of the embodiment, and should not limit any other possible embodiments that can change the configuration or spatial distance between the input and output coupling elements during lamp operation.

Further details of the methods of tuning the impedance of a plasma lamp are described using the following examples.

FIG. 1 is a simplified flow diagram of a tuning method for a plasma lamp according to an embodiment of the present invention. The plasma lamp is comprised of a RF power source, bulb, and resonator structure. During operation of lamp, tuning can be conducted to initiate a change of the impedance of the resonator structure.

Figure 2:
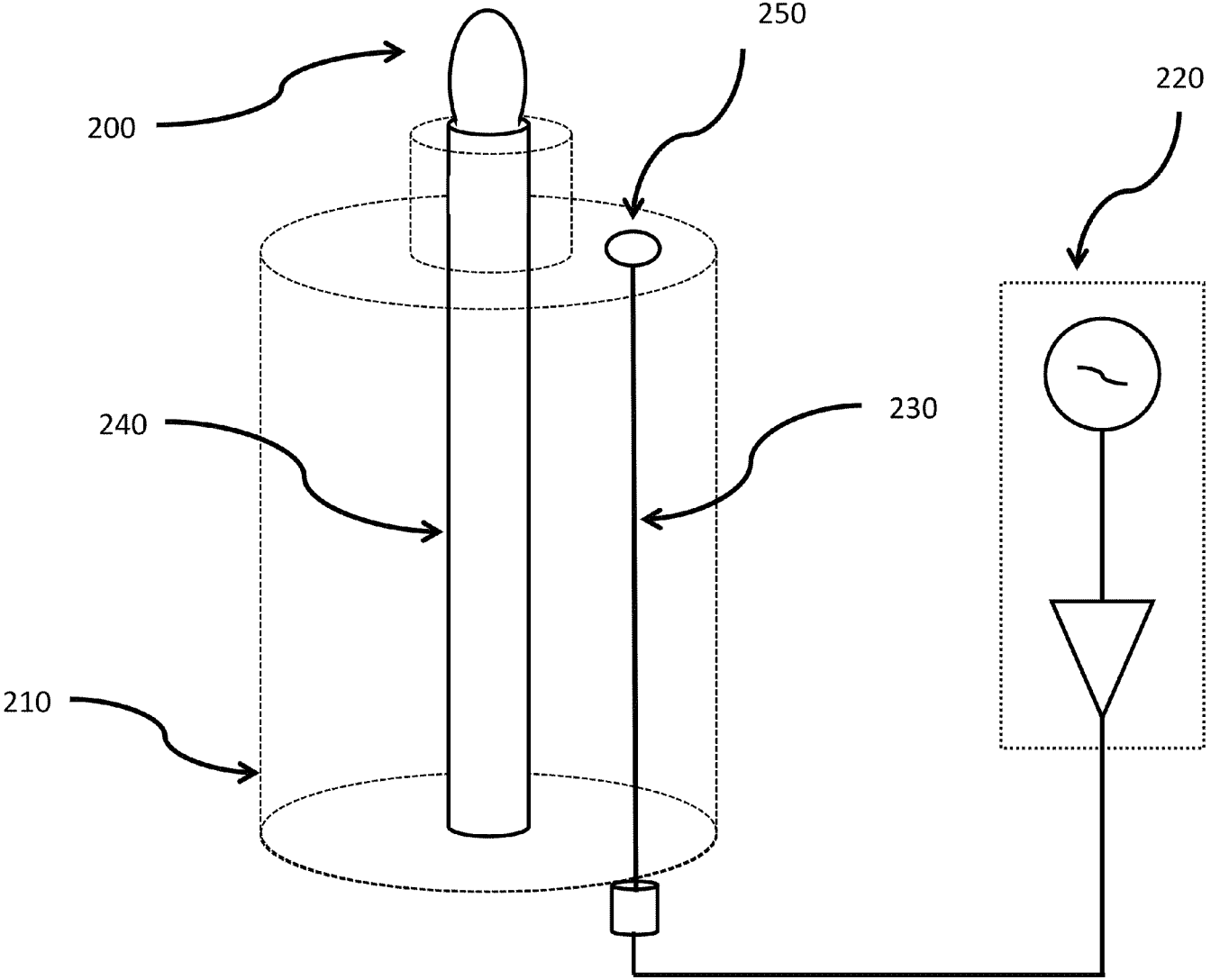
FIG. 2 is a plasma lamp, including tuning device, according to an embodiment of the present invention.

FIG. 2 is a plasma lamp, including tuning device, according to an embodiment of the present invention. The plasma lamp is comprised of three main elements: the bulb (200) comprising of a fill mixture, the resonator structure (210) containing an output coupling element (240) configured with the bulb and an input coupling element (230) configured with the RF power source (220). The input coupling element and output coupling element are separated spatially. A tuning element (250) is typically configured with or near the input coupling element (230) and is used to initiate a change in the resonator structure impedance.

Figure 3A:
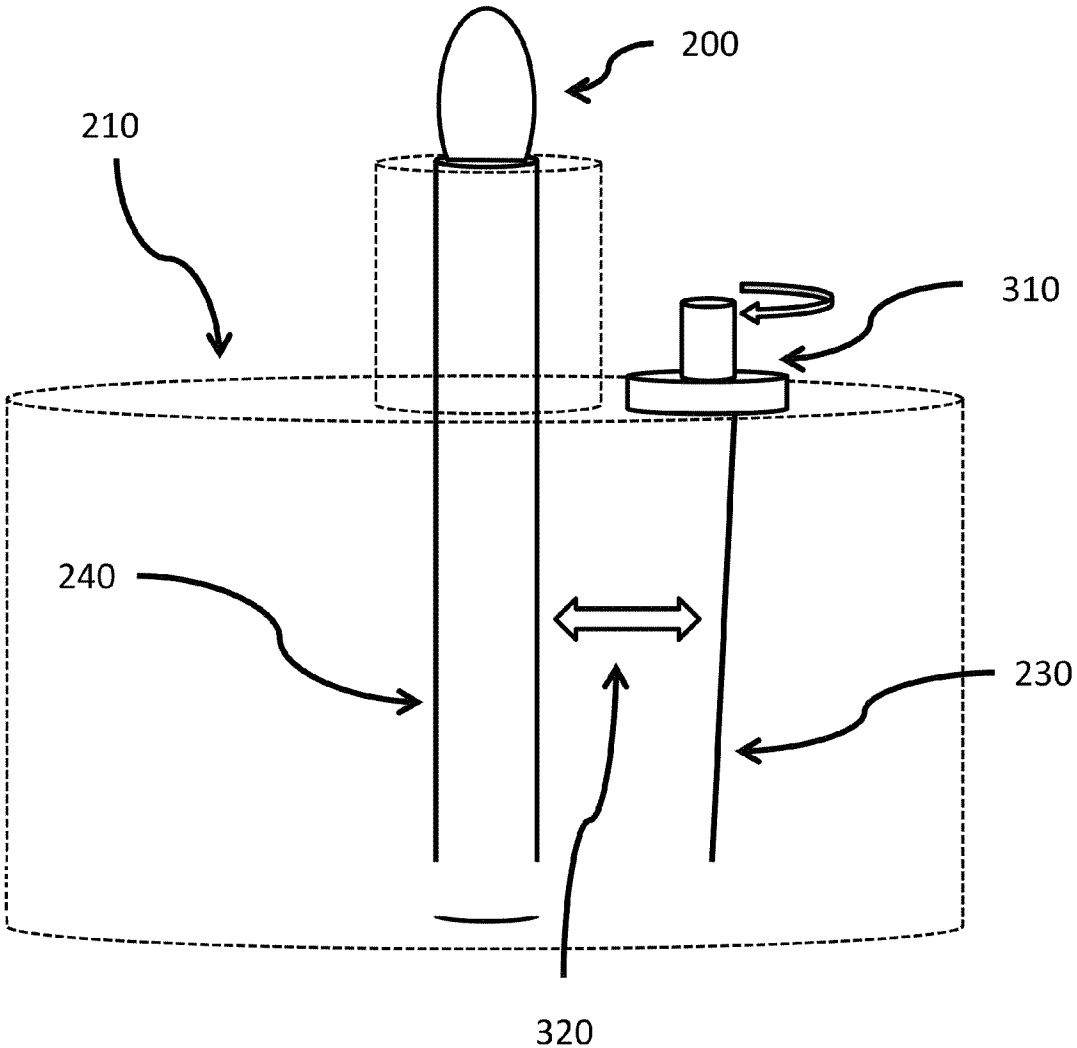
FIGS. 3A-3E are detailed diagrams of a resonator structure illustrating various tuning devices of the plasma lamp according to embodiments of the present invention.
Figure 3B:
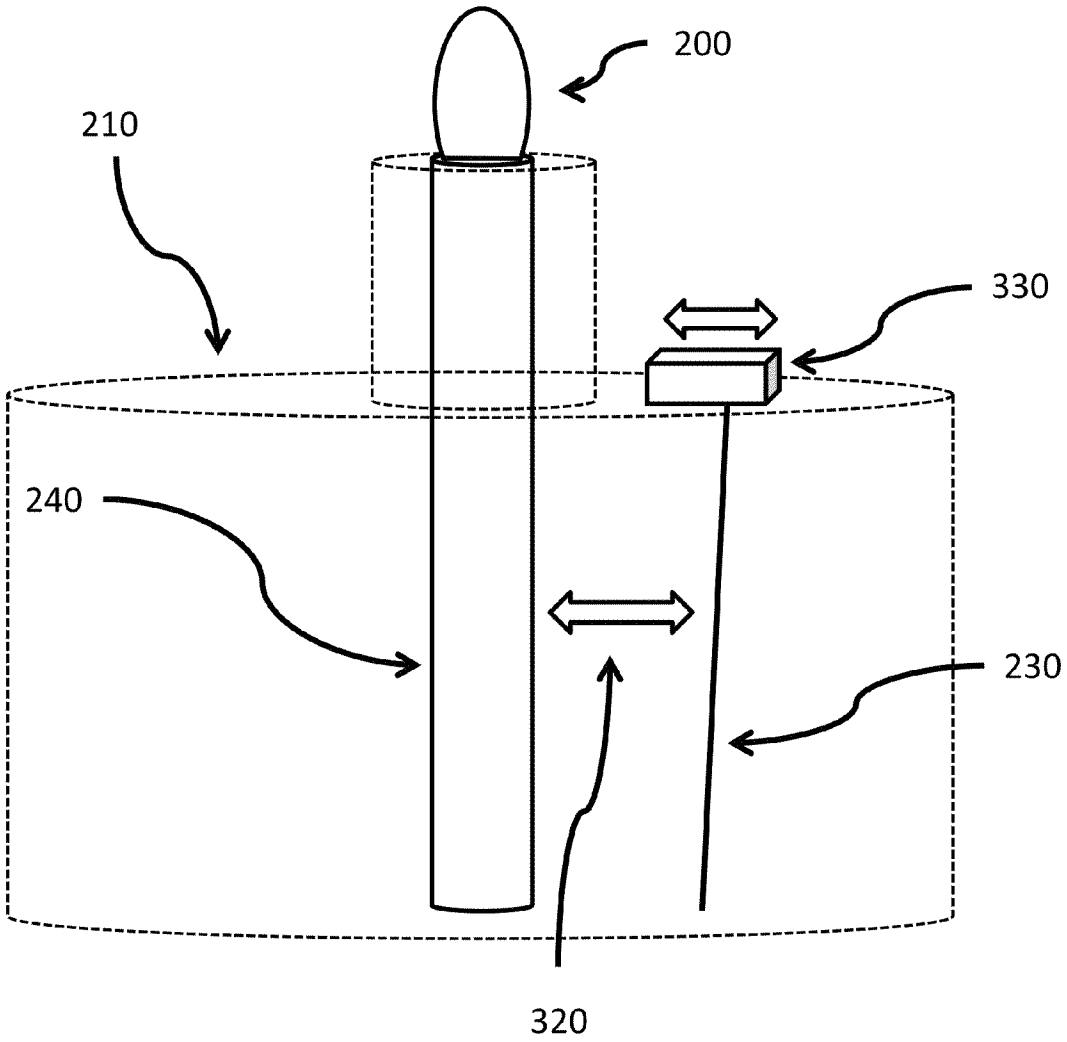
Figure 3C:
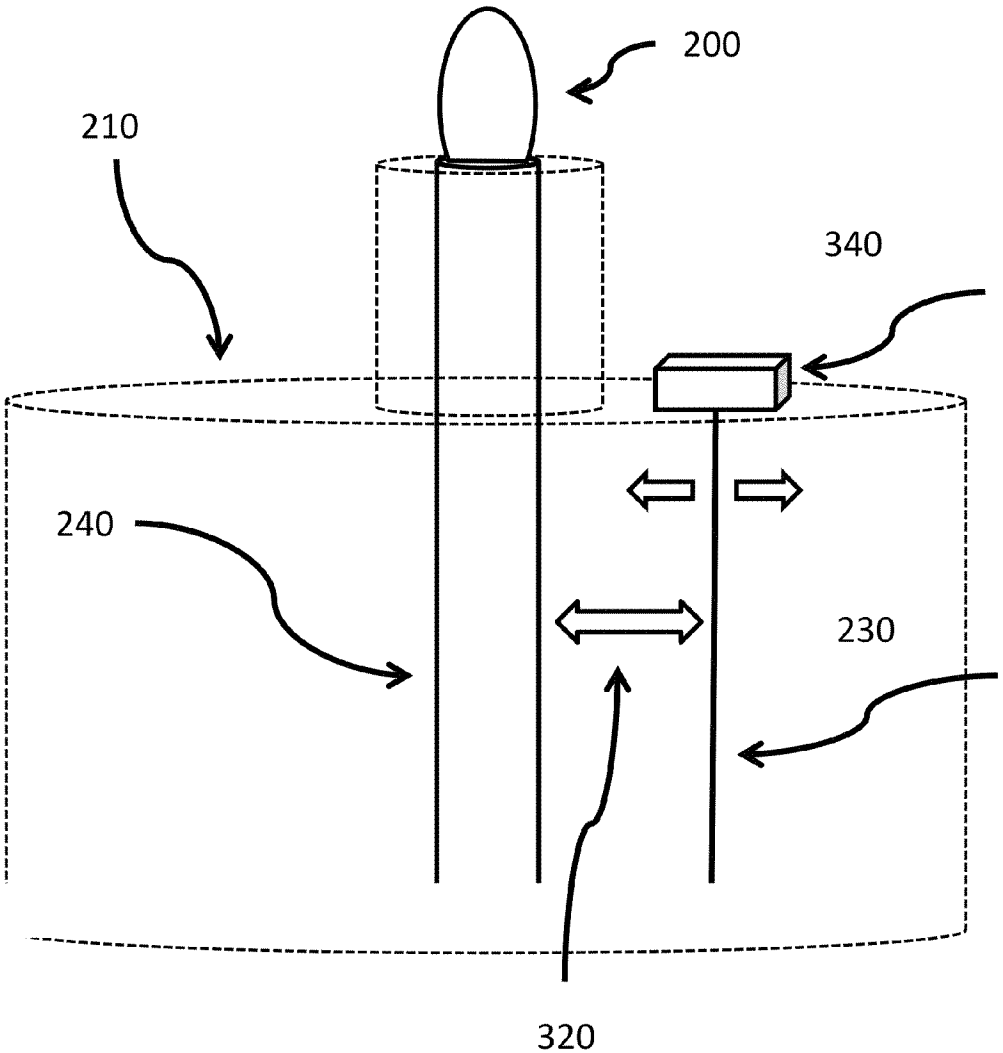
Figure 3D:
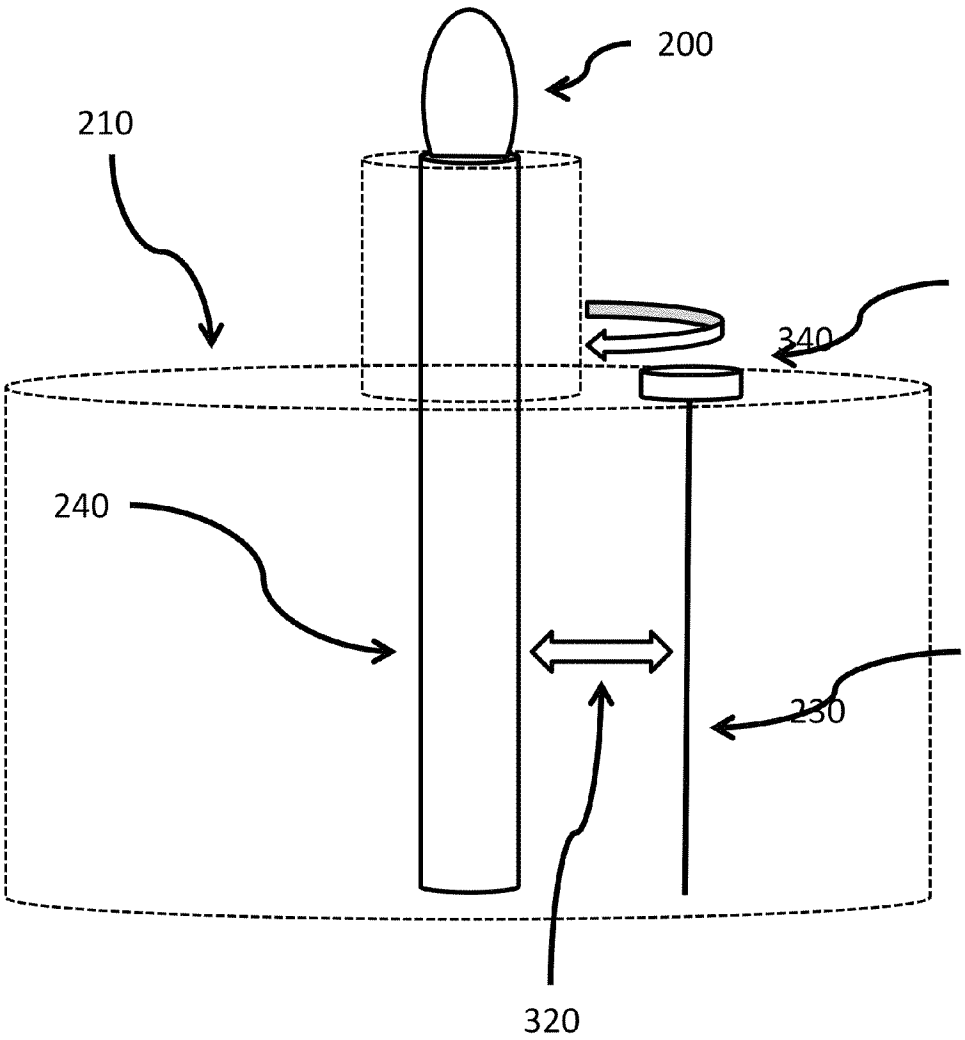
Figure 3E:
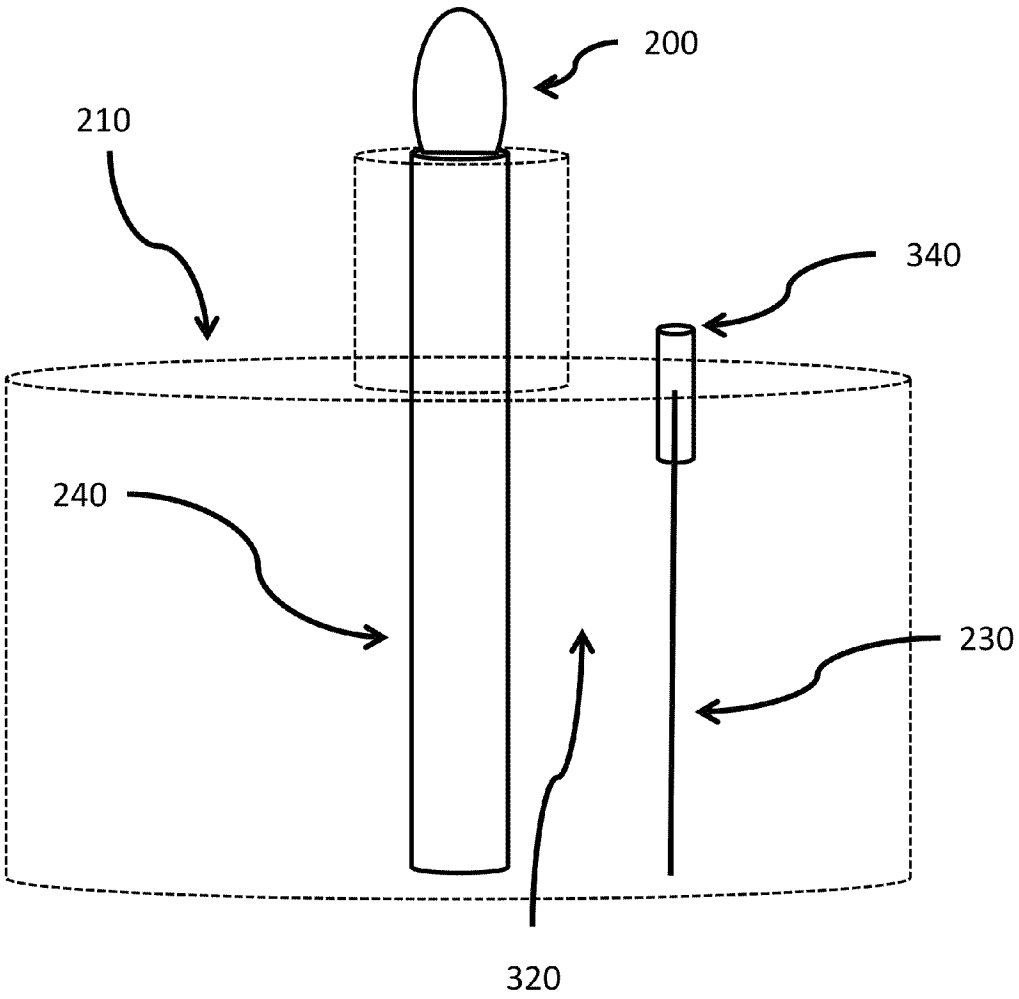

FIGS. 3A-3E are detailed diagrams of a resonator structure illustrating various tuning devices of the plasma lamp according to embodiments of the present invention. In FIG. 3A, the tuning device (310) is a rotating dial that is configured with the input coupling element (230) in an offset manner, allowing the input element to tilt in relation to the output coupling element (240) adjusting the spatial distance (320) and configuration between the coupling elements. In FIG. 3B, the tuning device (330) is a linear translating element that is configured with the input coupling element (230), allowing the input element (which is fixed opposite to the tuning element) to tilt in one plane in relation to the output coupling element (240) adjusting the spatial distance (320) and configuration between the coupling elements. In FIG. 3C, the tuning device (340) is a linear translating element or elements that is or are configured with the input coupling element (230), allowing the input element (which is NOT fixed opposite to the tuning element) to translate in one or more planes in relation to the output coupling element (240) adjusting the spatial distance (320) and configuration between the coupling elements. In FIG. 3D, the tuning device (340) is a rotating (with rotation of axis along the same axis of the output coupling element) element or elements configured with the input coupling element that allows the input element (which is NOT fixed opposite to the tuning element) to rotate in a spiral manner to change the relation to the output coupling element (240) adjusting the spatial distance (320) and configuration between the coupling elements. In FIG. 3E, the tuning device (340) is a metal, metallize dielectric, or dielectric rod or sheath that is configured between the input coupling element (230) and output coupling element (240), configured with the input coupling element, or configured with the output coupling element adjusting the configuration between the coupling elements to initiate a change in the impedance of the resonator structure.

Figure 4:
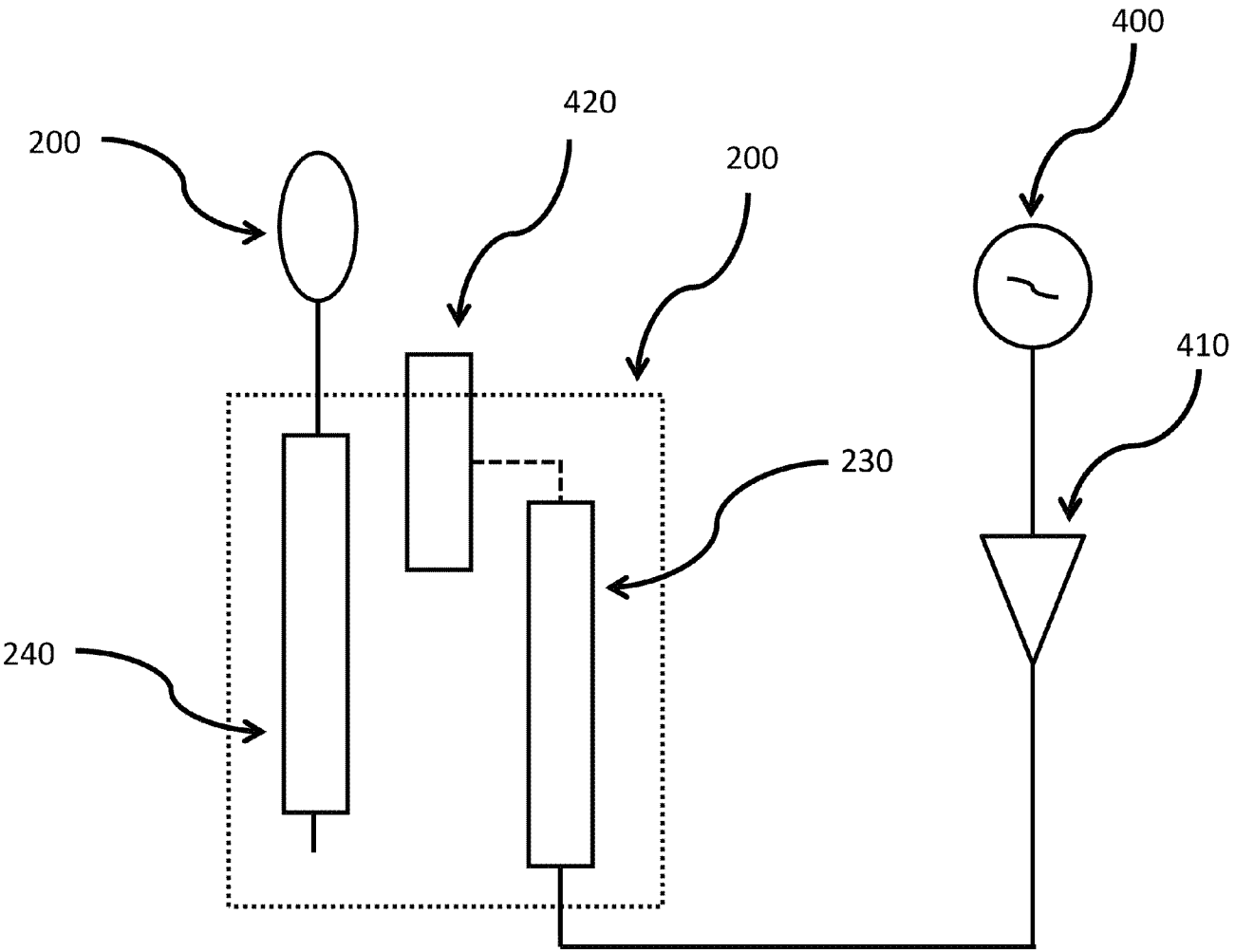
FIG. 4 is a simplified block diagram of the plasma lamp.

FIG. 4 is a simplified block diagram of the plasma lamp, including electronic blocks, loads, tuning device, according to an embodiment of the present invention. The plasma lamp is powered by a RF power source (400) and amplifier system (410). The RF power source is coupled with an input coupling element (230). The input coupling element is configured with the resonator structure (200). Also configured with the resonator structure is an output coupling element (240). The output coupling element is configured with a bulb structure (200) that emits electromagnetic radiation when powered. A tuning element (420) can be configured between the input and output coupling element, configured with the input coupling element, or configured with the output coupling element to adjust the impedance value of the resonator structure. The tuning element is used to initiate a change in the power transfer from the RF power source to the bulb or to initiate a change in the efficiency of the RF power source.

Figure 5:
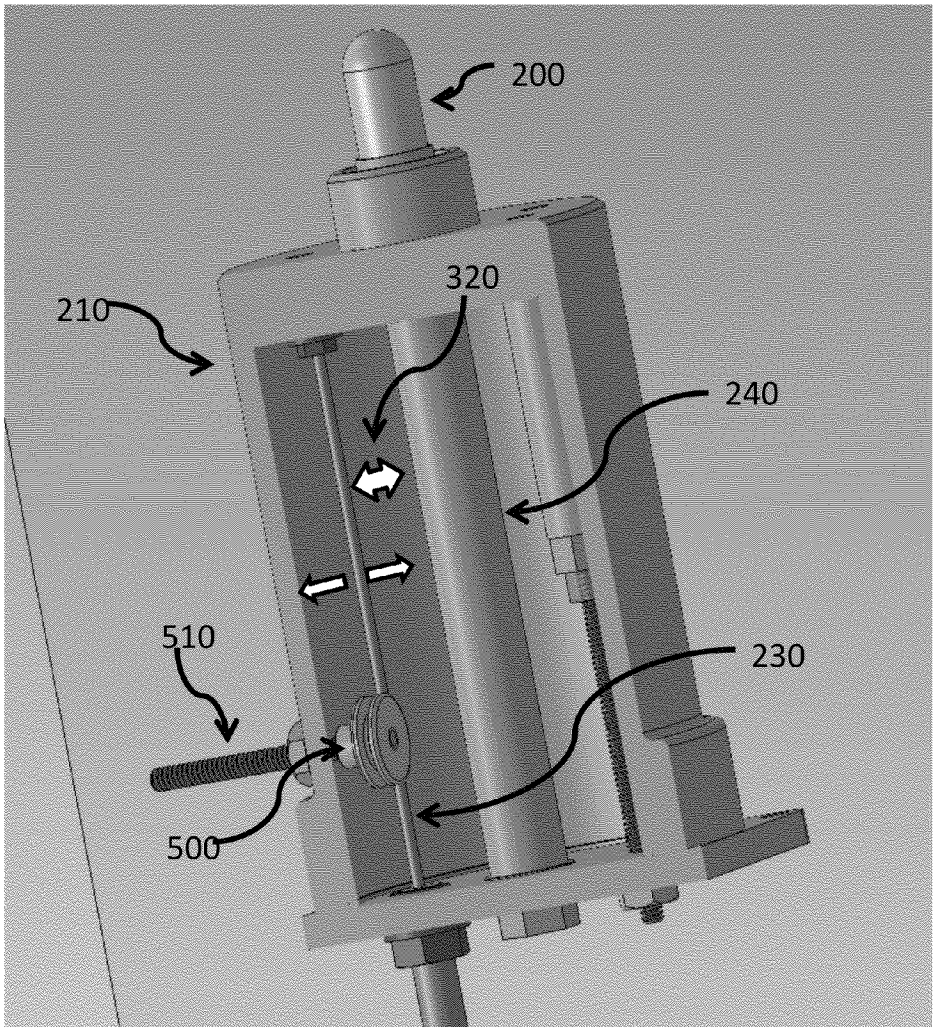
FIG. 5 is a drawing of the resonator structure showing a particular embodiment of the present invention

FIG. 5 is a drawing of a plasma lamp showing a particular embodiment of the present invention. The plasma lamp is comprised of a bulb (200) comprising of a fill mixture, a resonator structure (210) containing an output coupling element (240) configured with the bulb and an input coupling element (230) configured with the RF power source (not shown). In this embodiment, a tuning element includes a rotating grooved spool (500) that is controlled by a threaded tuning rod (510). This rod is rotated to cause the spool to push or pull the input coupling element (230) in a linear motion to vary the distance (320) between the input coupling element and output coupling element (240) during operation of the lamp.

In embodiments of the invention, the adjustment device comprises a rotating dial configured to linearly actuate the input coupling element to move the spatial distance between the input coupling element and the output coupling element. In an example, the adjustment device comprising a lever arm structure having a first end and a second end. In an example, the first end is fixed to pivot about a region of the first end. In an example, the second end is attached to the input coupling element. More generally, the lever arm structure configured to pivot about an axis while moving in an arc about the axis. The lever arm structure is configured to the input coupling element to tilt a portion of the input coupling element towards or away from the output coupling element to change a spatial distance between the portion of the input coupling element and the output coupling element. The lever arm structure is made of a suitable material such as a metal, or is metallized to be conductive in an example. The metal can be aluminum, brass, steel, or the like.

An example of a lamp structure that can be configured with the tuning technique is described in U.S. Pat. No. 7,830,092 issued Nov. 9, 2010, and titled "Electrodeless lamps with externally-grounded probes and improved bulb assemblies," commonly assigned, and hereby incorporated by reference in its entirety.

While the above is a full description of the specific embodiments, various modifications, alternative constructions and equivalents may be used. Therefore, the above description and illustrations should not be taken as limiting the scope of the present invention which is defined by the appended claims.

What is claimed is:

1. A method for operating a plasma lamp apparatus, the method comprising:

providing a resonator structure configured with a bulb comprising a fill mixture, the bulb being coupled to an output coupling element;

applying an RF power source to a resonator structure configured with an input coupling element;

coupling the RF power to the output coupling element configured with the input coupling element to cause the fill mixture to discharge electromagnetic radiation;

adjusting a spatial distance or relative configuration between the input coupling element and the output coupling element during output of the electromagnetic radiation; and causing a change in an impedance value of the resonator structure to initiate an adjustment of a power transfer from the RF power source to an output of the electromagnetic radiation.

2. The method of claim 1, wherein the change of the impedance value of the resonator structure matches the impedance value of the RF power source and the bulb to improve or maximize power transfer from the RF power source to the output of the electromagnetic radiation.

3. The method of claim 1, wherein the change of the impedance value of the resonator structure increases the power transfer from the RF power source to the output of the electromagnetic radiation.

4. The method of claim 1, wherein the change of the impedance value of the resonator structure adjusts an efficiency value of the RF source.

5. The method of claim 1, wherein the adjusting of the spatial distance comprising rotating a dial configured with the input coupling element in an off-set manner to move the spatial distance between the input coupling element and the output coupling element as the dial is rotated during the discharge of the electromagnetic radiation.

6. The method of claim 1, wherein the adjusting of the spatial distance comprising linearly tilting the input coupling element to move the spatial distance between the input coupling element and the output coupling element.

7. The method of claim 1, wherein the adjusting of the spatial distance comprising linearly translating the input coupling element to move the spatial distance between the input coupling element and the output coupling element.

8. The method of claim 1, wherein the adjusting of the spatial distance comprising linearly translating the input coupling element along a single plane to move the spatial distance between the input coupling element and the output coupling element.

9. The method of claim 1, wherein the adjusting of the spatial distance comprising linearly translating the input coupling element along a first plane and a second plane to move the spatial distance between the input coupling element and the output coupling element.

10. The method of claim 1, wherein the adjusting of the spatial distance comprising linearly translating the input coupling element along a first plane and a second plane to move the spatial distance between the input coupling element and the output coupling element, the adjusting occurring through a spiral spatial region defined around the output coupling element or a diagonal spatial region defined within a vicinity of the output coupling element.

11. The method of claim 1, further comprising fixing the spatial distance between the input coupling element and the output-coupling element using a locking device.

12. The method of claim 1, wherein the adjusting comprising increasing an effective diameter of the input coupling element to change the relative configuration between the input and output coupling element.

13. The method of claim 1, wherein the adjusting comprising deflecting the input coupling element to change the spatial distance between the input coupling element and the output coupling element.

14. The method of claim 1, wherein the adjusting comprising the introduction of a tuning element in the vicinity of the input or output coupling element to change the relative configuration between the input and output coupling element.

15. The method of claim 14, wherein the tuning element is a metal, metalized dielectric, purely dielectric rod, or sheath.

16. A plasma lamp apparatus, comprising:

a resonator structure configured with a bulb comprising a fill mixture, the bulb being coupled to an output coupling element;

an RF power source configured to a resonator structure configured with an input coupling element, the RF power being coupled to the output coupling element configured with the input coupling element to cause the fill mixture to discharge electromagnetic radiation;

an adjustment device configured to adjust a spatial distance or relative configuration between the input coupling element and the output coupling element during output of the electromagnetic radiation causing a change in an impedance value of the resonator structure to initiate an adjustment of a power transfer from the RF power source to an output of the electromagnetic radiation.

17. The apparatus of claim 16, wherein the change of the impedance value of the resonator structure matches the impedance value of the RF power source and the bulb to improve or maximize power transfer from the RF power source to the output of the electromagnetic radiation; and wherein the change of the impedance value of the resonator structure adjusts an efficiency value of the RF source.

18. The apparatus of claim 16, wherein the adjustment device is configured to adjust the spatial distance comprising a rotating dial configured with the input coupling element in an off-set manner to move the spatial distance between the input coupling element and the output coupling element as the rotating dial is rotated during the discharge of the electromagnetic radiation.

19. The apparatus of claim 16, wherein the adjustment device comprising a rotating dial configured to linearly actuate the input coupling element to move the spatial distance between the input coupling element and the output coupling element.

20. The apparatus of claim 16, wherein the adjustment device comprising a lever arm structure configured to pivot about an axis while moving in an arc about the axis, the lever arm structure is configured to the input coupling element to tilt a portion of the input coupling element towards or away from the output coupling element to change a spatial distance between the portion of the input coupling element and the output coupling element.

* * * * *